US011624161B1

(12) United States Patent
Keigley

(10) Patent No.: US 11,624,161 B1
(45) Date of Patent: Apr. 11, 2023

(54) ROLLER ATTACHMENTS FOR WORK MACHINES AND OPERATION THEREOF

(71) Applicant: ABI ATTACHMENTS INC., Mishawaka, IN (US)

(72) Inventor: Kevin V. Keigley, Osceola, IN (US)

(73) Assignee: ABI Attachments, Inc., Mishawaka, IN (US)

( * ) Notice: Subject to any disclaimer, the term of this patent is extended or adjusted under 35 U.S.C. 154(b) by 0 days.

(21) Appl. No.: 16/952,247

(22) Filed: Nov. 19, 2020

Related U.S. Application Data

(60) Provisional application No. 62/937,515, filed on Nov. 19, 2019.

(51) Int. Cl.
*E01C 19/28* (2006.01)

(52) U.S. Cl.
CPC ..... *E01C 19/282* (2013.01); *E01C 19/286* (2013.01); *E01C 19/288* (2013.01)

(58) Field of Classification Search
CPC ..... E01C 19/282; E01C 19/286; E01C 19/288
USPC ..... 404/117, 121–130
See application file for complete search history.

(56) References Cited

U.S. PATENT DOCUMENTS 753,452 A 3/1904 Van Brunt
1,265,733 A * 5/1918 Brown ..... E01C 19/26 404/123
2,015,891 A * 10/1935 Greiner ..... E01C 19/26 89/1.13
2,029,659 A * 2/1936 Greiner ..... E01C 19/266 404/123
2,089,591 A * 8/1937 Aitken ..... E01C 19/26 404/123
2,099,590 A * 11/1937 Aitken ..... E01C 19/266 404/123
2,114,069 A * 4/1938 Aitken ..... E01C 19/266 404/123
2,114,412 A * 4/1938 Wilson ..... E01C 19/266 404/123
2,131,947 A * 10/1938 Gilmore ..... E02D 3/026 172/554
2,277,880 A 3/1942 Noble
2,292,488 A 8/1942 Stevens
(Continued)

FOREIGN PATENT DOCUMENTS

FR 2567352 1/1986
FR 2584561 1/1987
JP 3913147 * 3/2020 ..... E02F 9/20

*Primary Examiner* — Raymond W Addie
(74) *Attorney, Agent, or Firm* — Taft, Stettinius & Hollister LLP

(57) ABSTRACT

A work machine includes a roller rotatably coupled with a chassis by a suspension and an actuator operatively coupled with the chassis and the suspension and adjustable to adjust the suspension and the roller to a first position wherein the roller is raised above an underlying ground surface with rearward and forward wheels contacting an underlying ground surface, a second position wherein the roller is in contact with the underlying ground surface with the rearward and forward wheels contacting the underlying ground surface, and a third position wherein the roller is in contact with the underlying ground surface with the rearward wheels contacting the underlying ground surface and the forward wheels raised above the underlying ground surface.

20 Claims, 14 Drawing Sheets

(56) References Cited

U.S. PATENT DOCUMENTS 2,358,298 A 9/1944 Benjamin
2,683,404 A 7/1954 Buhr
2,687,074 A 8/1954 Tanke et al.
2,692,543 A 10/1954 Tanke
2,705,445 A 4/1955 Enrico
2,730,031 A 1/1956 Buhr
2,743,655 A 5/1956 Rafferty
2,815,704 A 12/1957 Slater
3,004,611 A 10/1961 Tanke
3,048,229 A 8/1962 Simpson
3,048,981 A 8/1962 Hing
3,101,794 A 8/1963 Bechman
3,305,028 A 2/1967 Schaper
4,030,428 A 6/1977 Truax
4,077,478 A 3/1978 Neukom
4,116,140 A 9/1978 Anderson et al.
4,131,162 A 12/1978 Schmitz
4,149,475 A 4/1979 Bailey et al.
4,223,742 A 9/1980 Stark
4,275,670 A 6/1981 Dreyer
4,311,104 A 1/1982 Steilen
4,322,094 A * 3/1982 Bobard ..... B62D 49/085 280/755
4,356,644 A 11/1982 Harkness
4,359,101 A 11/1982 Gagnon
4,396,069 A 8/1983 Ferber et al.
4,679,634 A 7/1987 Bulmahn
4,693,331 A 9/1987 Johnson et al.
4,700,785 A 10/1987 Bartusek et al.
4,724,910 A 2/1988 Wheeler
4,871,026 A 10/1989 Bernard
4,930,580 A 6/1990 Fuss et al.
5,065,681 A 11/1991 Hadley
5,366,024 A 11/1994 Payne
5,417,293 A 5/1995 Leader
5,685,245 A 11/1997 Bassett
5,727,638 A 3/1998 Wodrich et al.
5,806,606 A 9/1998 Robinson
5,993,110 A * 11/1999 Bueno ..... E02D 3/026 404/130
6,044,916 A 4/2000 Hundeby
6,431,287 B1 8/2002 Ramp
6,533,307 B1 3/2003 Singh
6,606,956 B1 8/2003 Paluch
6,701,857 B1 3/2004 Jensen et al.
7,093,380 B2 8/2006 Hubscher et al.
7,140,804 B2 * 11/2006 Gregg ..... E01C 19/43 404/93
7,540,689 B1 * 6/2009 Major, Sr. ..... E01C 19/266 404/128
7,743,844 B2 6/2010 Kovach et al.
7,853,373 B2 * 12/2010 Traster ..... A01D 34/008 701/25
8,047,299 B2 11/2011 Hurtis
8,186,906 B2 * 5/2012 Zimmerman ..... E04G 21/10 404/117
8,275,525 B2 9/2012 Kowalchuk
8,286,566 B2 10/2012 Schilling et al.
8,555,798 B2 10/2013 Schilling et al.
9,883,621 B2 2/2018 Keigley
2003/0164125 A1 9/2003 Paluch et al.
2008/0011496 A1 1/2008 Garrison et al.
2008/0142233 A1 6/2008 Hurtis et al.
2011/0083867 A1 4/2011 Leith
2011/0120357 A1 5/2011 Schilling et al.
2011/0313572 A1 12/2011 Kowalchuk et al.
2013/0264080 A1 10/2013 Keigley
2016/0251809 A1 * 9/2016 Ries ..... E01C 19/26 404/130

* cited by examiner

ROLLER ATTACHMENTS FOR WORK MACHINES AND OPERATION THEREOF

CROSS-REFERENCE TO RELATED APPLICATIONS

The present application claims priority to and the benefit of U.S. Application No. 62/937,515, filed Nov. 19, 2019, the disclosure of which is hereby incorporated by reference.

BACKGROUND

The present application relates generally to roller attachments for work machines and operation thereof. The working of earth or substrate is a necessary part of landscaping, grounds keeping, building and construction projects. Depending on the application and starting composition of the earth or substrate, a number of working operations may be performed including, for example, compaction, culipaction or other operations to vary the compaction or density of the underlying ground surface. A number of apparatuses, systems, and methods have been proposed for such applications, yet heretofore have suffered from a number of drawbacks and disadvantages. There remains a significant need for the unique apparatuses, systems, and methods disclosed herein.

DISCLOSURE OF ILLUSTRATIVE EMBODIMENTS

For the purposes of clearly, concisely, and exactly describing example embodiments of the disclosure, the manner, and process of making and using the same, and to enable the practice, making and use of the same, reference will now be made to certain example embodiments, including those illustrated in the figures, and specific language will be used to describe the same. It shall nevertheless be understood that no limitation of the scope of the invention is thereby created and that the invention includes and protects such alterations, modifications, and further applications of the example embodiments as would occur to one skilled in the art.

SUMMARY OF THE DISCLOSURE

One example embodiment is a unique work machine including a roller rotatably coupled with a chassis by a suspension and an actuator operatively coupled with the chassis and the suspension and adjustable to adjust the suspension and the roller to a first position wherein the roller is raised above an underlying ground surface with rearward and forward wheels contacting an underlying ground surface, a second position wherein the roller is in contact with the underlying ground surface with the rearward and forward wheels contacting the underlying ground surface, and a third position wherein the roller is in contact with the underlying ground surface with the rearward wheels contacting the underlying ground surface and the forward wheels raised above the underlying ground surface. Further embodiments, forms, objects, features, advantages, aspects, and benefits shall become apparent from the following description and drawings.

DETAILED DESCRIPTION OF ILLUSTRATIVE EMBODIMENTS

Figure 1:
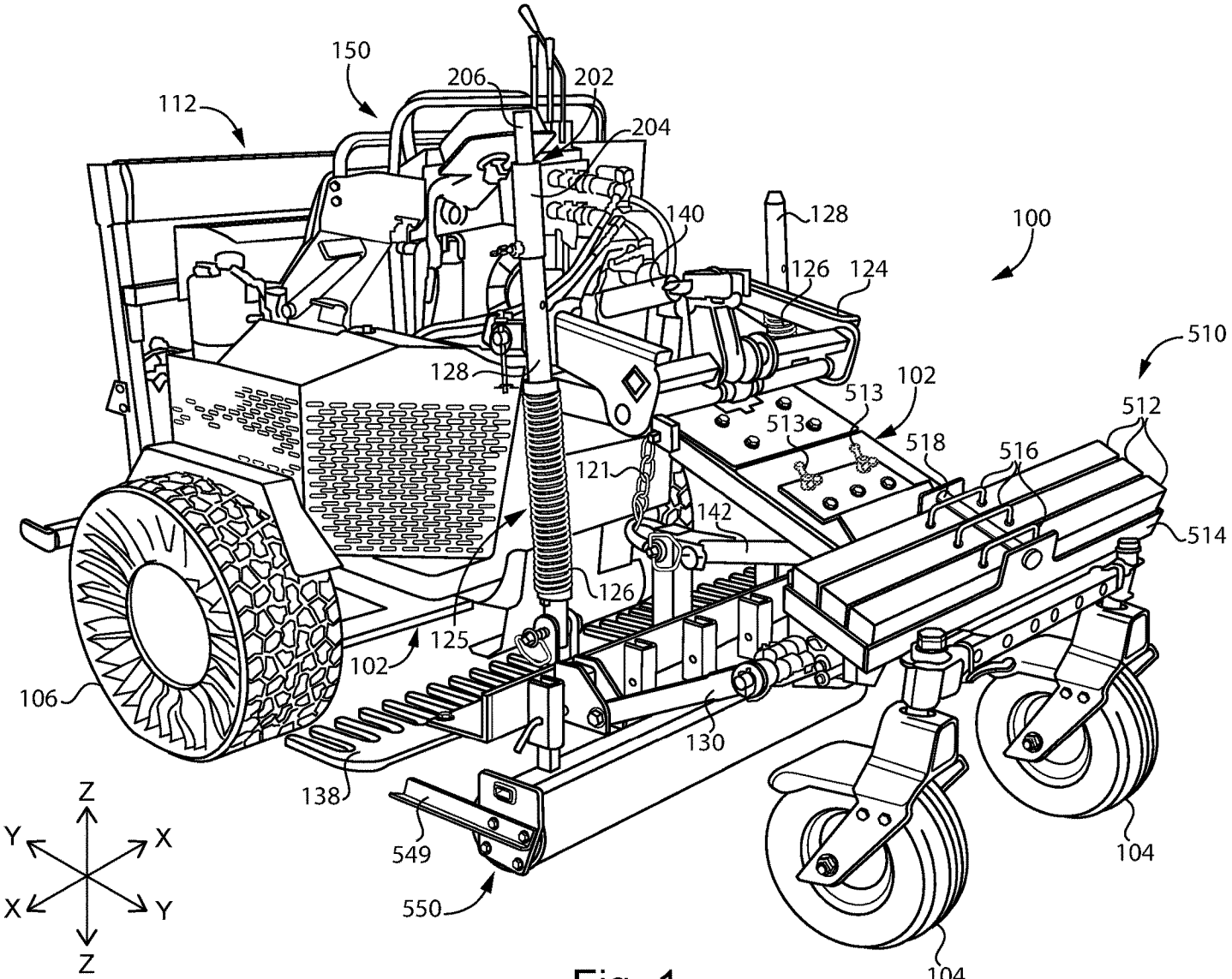
FIG. 1 is a perspective view illustrating certain aspects of an example work machine operatively coupled with a ground engaging roller attachment.

Referring now to the figures and with initial reference to FIG. 1 in particular, there is illustrated a perspective view of an example work machine 100 operatively coupled. In the illustrated embodiments, work machine 100 is a light-duty work machine with a substantially zero turning radius. It shall be appreciated, however, that other types of work machines may also be utilized in connection with the automatic grading systems and components disclosed herein.

Work machine 100 is one example of a self-propelled light-duty work machine. In a preferred embodiment work machine 100 has a weight of about 1100 pounds and a propulsion system comprising a rated power of 18 hp or less. Additional embodiments comprise self-propelled light-duty work machines including a propulsion system comprising a rated power of 25 hp or less, weighing 1500 pounds or less, or comprising both of said attributes. Further embodiments comprise self-propelled light-duty work machines including a propulsion system comprising a rated power of 30 hp or less, weighing 2000 pounds or less, or comprising both of said attributes.

Work machine 100 includes a chassis 102 supported by front wheels 104 and rear wheels 106 which contact a ground surface and support the chassis 102. In the illustrated embodiments the chassis 102 is configured to provide an example frame structure with which various work machine elements and tool elements are coupled. It shall be appreciated that the chassis of work machines according to other embodiments may comprise a variety of structures including frame-based chassis, unibody chassis, or other types of chassis or support structures that are configured to be supported by ground-contacting wheels or other ground-contacting members and coupled with one or more soil working tools. It shall be appreciated front wheels 104 and rear wheels 106 are two examples of ground-contacting members which may be utilized in connection with a work machine such as work machine 100 and that other forms of ground-contacting members are also contemplated, for example, continuous tracks, trucks, or other types of ground-contacting members as would occur to one of skill in the art with the benefit of the present disclosure.

In the illustrated embodiment the front wheels 104 of work machine 100 are configured as caster type wheels which preferably are rotatable 360 degrees relative to the chassis 102. It shall be appreciated that a variety of differently configured front wheels 104 may be utilized including, for example, front wheels provided on an axle, rack and pinion assembly, or other types of front end steering assembly and/or front end drive assembly. It shall be further appreciated that additional embodiments may include only a single front wheel, a greater number of front wheels or may include ground surface contacting elements other than wheels, such as treads or tracks. While the front wheels 104 are non-driven wheels in the illustrated embodiments, it shall be appreciated that other embodiments comprise one or more driven front wheels configured to provide at least part of the propulsion to the work machine.

In the illustrated embodiments the rear wheels 106 of work machine 100 are coupled with a machine prime mover. In a preferred embodiment, the prime mover comprises an internal combustion engine configured to drive a hydraulic pump that is flow coupled with a hydraulic drive system configured to provide torque to the rear wheels 106. Example hydraulic drive systems may include elements such as high-pressure accumulators, low-pressure reservoirs, secondary pumps, gearboxes, collectors and/or differentials. In other embodiments, the prime mover is configured as an internal combustion engine configured to provide driving torque through an output shaft. In other embodiments, the prime mover comprises an internal combustion engine and/or an electric motor configured to provide output torque. The electric motor may be powered by a battery or other power storage source, by a generator driven by an internal combustion engine, or a combination thereof.

In the illustrated embodiments each of the rear wheels 106 is independently controllable and drivable in a forward or reverse direction, though other embodiments may comprise different drive wheel arrangements, including front-wheel drive arrangements, all-wheel drive, and four-wheel drive arrangements, to name several non-limiting examples. Certain embodiments may comprise only a single rear-wheel or a greater number of rear wheels 106 or other ground-contacting members. Certain embodiments may include additional driven ground-contacting wheels, for example, two ground-contacting wheels may be provided on truck structures provided on either side of and pivotally coupled with the work machine in a tandem walking arrangement, and each of the four overall ground-contacting wheels may be independently driven by a hydraulic motor or an electric motor.

The chassis 102 supports an operator station 112 which includes a standing platform and a guard rail positioned at the aft end of work machine 100 adjacent to the standing platform. Operator controls 150 are positioned to be manipulatable by an operator occupying the operator station 112 in order to control movement or propulsion of the work machine 100 as well as the positioning of one or more tools carried by the work machine as further described herein. It shall be appreciated that operator control 150 may include one or more levers or other operator manipulatable controls that are operatively coupled with valves and hydraulic fluid lines to control one or more hydraulic actuators of the work machine. For clarity of illustration, these features have not been depicted in the illustrated embodiments. Furthermore, in certain embodiments, operator station 112 may comprise an operator seat instead of or in addition to a standing platform. In certain embodiments, the operator station 112 may be omitted and the machine may be controlled remotely using a separate operator control station in wireless communication with a controller provided on the work machine 100 and configured to control movement or propulsion of the work machine 100 as well as the positioning of one or more tools carried by the work machine.

Figure 2:
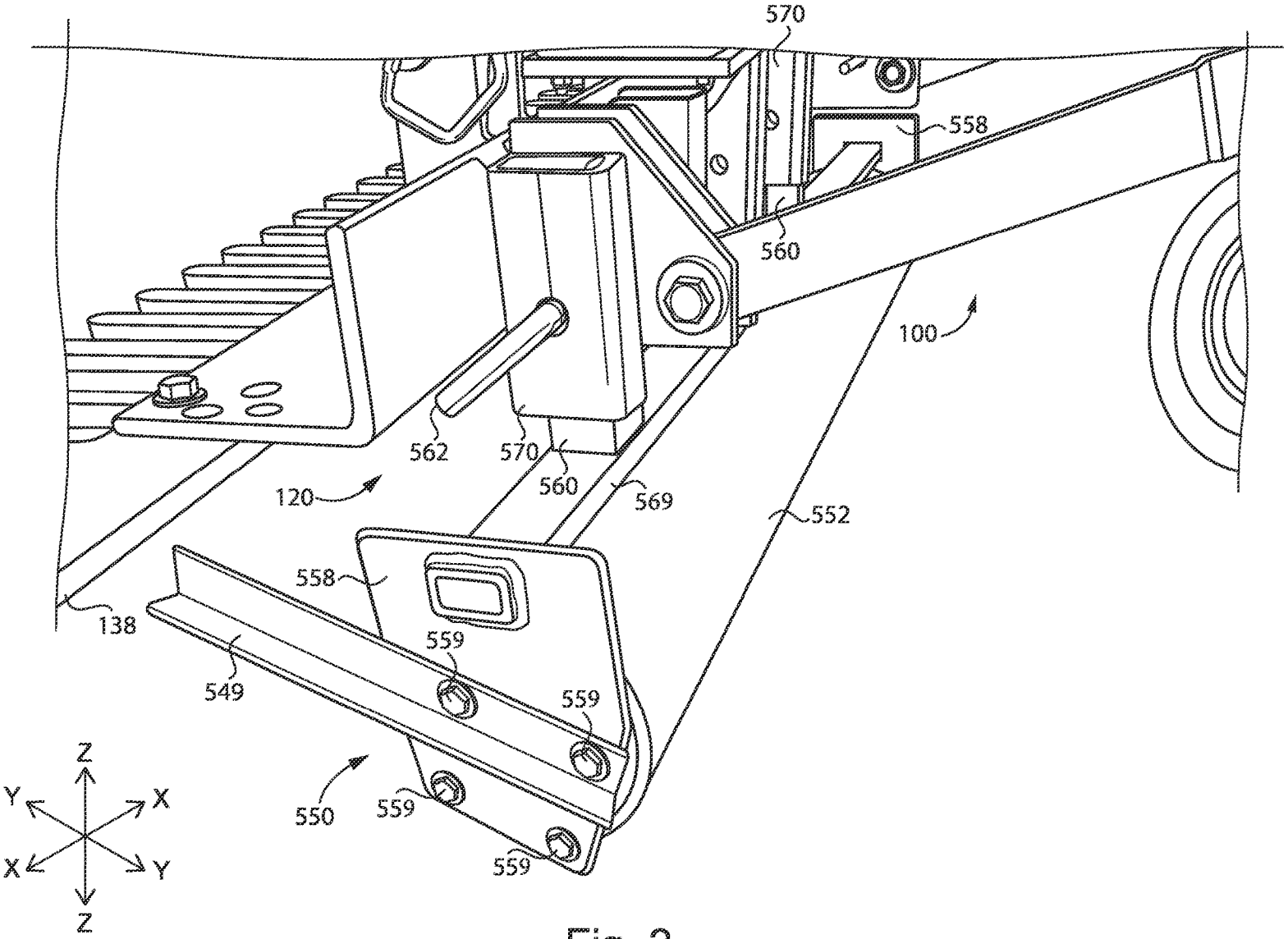
FIGS. 2-5 are several perspective views illustrating certain aspects of the example work machine and ground engaging roller attachment of FIG. 1.
Figure 3:
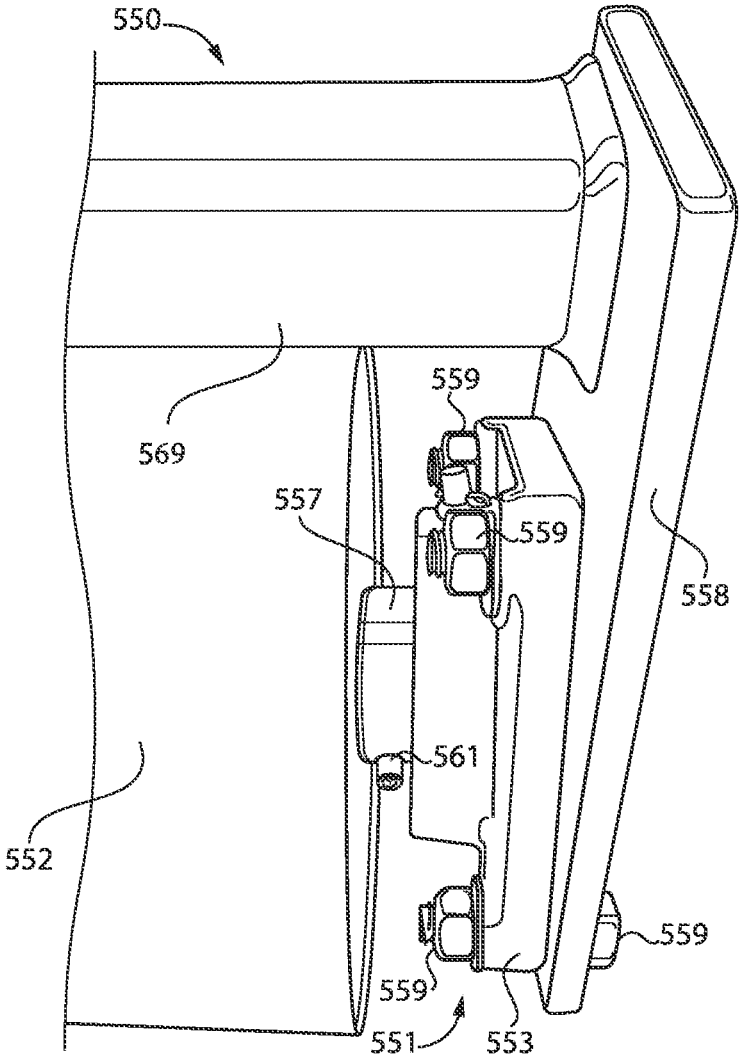
Figure 4:
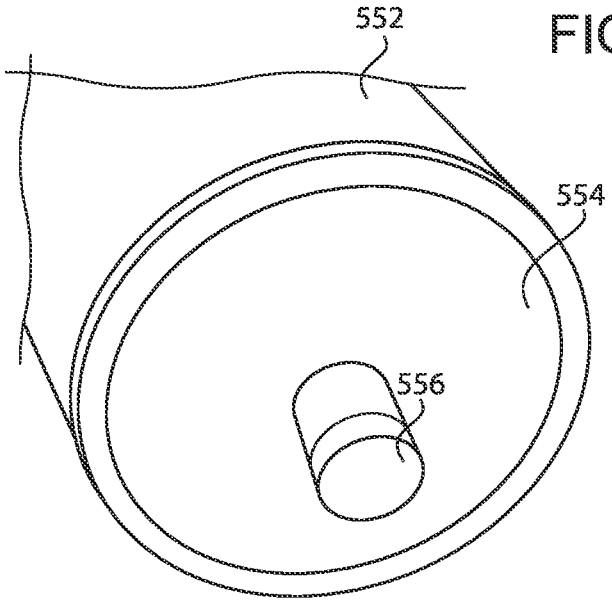
Figure 5:
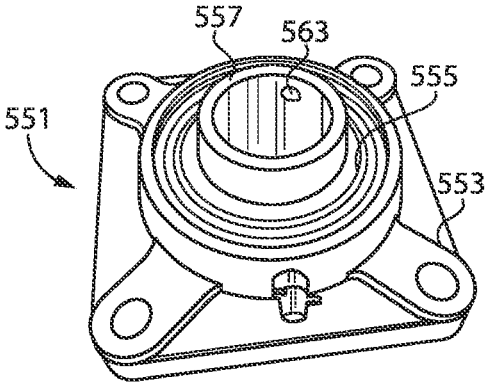

Work machine 100 includes a tool mount 120 which is operatively coupled with two attachments, namely a finishing comb 138 and a roller assembly 550 including a generally cylindrical, ground engaging roller body 552 (also referred to herein as roller body 552 or roller 552) extending along the width of the chassis 102. As shown most clearly in FIGS. 2 and 3, which illustrate first and second ends of roller assembly 550, as well as by FIGS. 4 and 5, which illustrate features of certain components of the roller assembly 550 not otherwise visible in FIG. 2 in a disassembled state, end members 554 are positioned at opposite ends of the roller body 552 and cover respective openings to a hollow interior the roller body 552 effective provide a substantially closed cylinder ends. Studs 556 extend from the respective end members 554 and are received by stud receptacles 557 of bearing assemblies 551. The studs 556 are maintained in a substantially fixed relationship with their respective stud receptacle 557 by respective fasteners 561 which are configured as set bolts in the illustrated embodiment but may be provided as other types of fasteners in other embodiments. Fasteners 561 which pass through openings 563 provided in sidewall of the respective stud receptacle 557 to engage the respective studs 556. The bearing assemblies 551 further includes sealed bearing 555 from which respective stud receptacles 557 extend and which are provided in respective bearing housings 553.

The bearing housings 553 are coupled with respective hanger members 558 by fasteners 559 which are configured as nut and bolt fasteners in the illustrated embodiment but may be provided as other types of fasteners in other embodiments. The hanger members 558 are fixedly coupled with and extend downward from a lateral member 569. Post members 560 extend upward from the lateral member 569 which extends along the width of chassis 102 and are received by receiving members 570 of tool mount 120. Fasteners 562 are inserted into and pass through apertures provided in the receiving members 570 and the post members 560 to provide fixed engagement therebetween and may be removed from to allow decoupling of the receiving members 570 and the post members 560.

A hanger stop member 549 is coupled with one of the hanger members 558 and extends along the length of the chassis 102. In other forms, an additional hanger stop member 549 is coupled with the other hanger members 558. Hanger stop member 549 is configured with an angle and length which maintain roller assembly 550 in a substantially predetermined position when decoupled from tool mount 120 by virtue of hanger stop member 549 contacting an underlying ground surface effective to limit rotation of hanger member 558. In a decoupled state, hanger stop member 549 is configured to rotate downward into engagement with the ground along hanger members 558, lateral member 559, and post members 560 which are coupled in a fixed relationship with one another. The predetermined position of roller assembly 550 may be selected to provide a predetermined angle and orientation of post members 560 relative to an underlying ground surface when hanger stop member 549 contacts and rests upon the underlying ground surface. The predetermined position may be selected to correspond with a particular adjustment state of tool mount 120 which can be achieved via the operation of operator controls 150. Hanger stop member 549 is preferably configured with a flat ground facing surface, such as the lower surface provided in the L-shaped cross-section of the illustrated embodiment, with a width in the effective limit a depth of penetration of hanger stop member 549 into the underlying ground surface relative to the penetration realized by a sharper or more narrow ground-contacting portion surface. Hanger stop member 549 also provides a visual indicia of the pitch at which the roller assembly 550 and the tool mount 120 have been adjusted relative to the underlying ground surface.

It shall be appreciated that roller assembly 550 may be provided alone or in combination with a number of other tools. For example, in certain embodiments, the finishing comb 138 may be removed or omitted and the tool mount 120 may be operatively coupled with the roller assembly 550 alone. In certain embodiments, the tool mount 120 may be operatively coupled with the roller assembly 550 and various ground engaging tools other than the finishing comb 138. In each instance the grading tool assembly provided by the operative coupling of the tool mount 120 with the roller 552 and possibly other tools is adjustable by actuation of operator controls 150. In one aspect, the actuation of operator controls may vary the height of the grading tool assembly in the Z-axis direction effective to raise the roller 552 above an underlying ground surface, to lower the roller 552 into contact with the underlying ground surface and to vary the Z-axis force on the roller 552. In another aspect the pitch of the grading tool assembly relative to the X-Y plane effective to position the grading tool assembly such that the roller 552 contacts the underlying ground surface while the finishing comb 138 or other ground engaging tools are maintained in a spaced-apart relationship relative to the underlying ground surface. It shall be appreciated that pitch adjustment can occur while maintaining a given height adjustment or concurrently with a height adjustment as further described herein.

Tool mount 120 is operatively coupled with an actuator 142 at a pivotable coupling 408. Actuator 142 is also coupled with the chassis 102 of work machine 100 at a pivotable coupling. Rocker 124 includes arm members 402 which are coupled with suspension 125. Rocker 124 also includes a shaft member which extends in a widthwise direction between arm members 402 and is coupled with the outer members and is coupled with pivotable coupling 408. Rocker 124 further includes an actuator connector 406 which is pivotally coupled with shaft member 404 and actuator 140. Rocker 124 further includes a lifting connector 358 which is pivotally coupled with shaft member 404 and lifting member 121. In the illustrated embodiments actuator 142 is configured as a hydraulic cylinder which is laterally expandable and contractible generally in the Y-axis direction. The operator controls 150 may be configured to control the supply of pressurized hydraulic fluid to actuator 142 to control its position. Tool mount 120 is also operatively coupled with a rocker 124 by a lifting member 121. Rocker 124 is coupled with actuator 140 at a pivotable coupling. Actuator 140 is also coupled with the chassis 102 of the work machine 100 at a further pivotable coupling. In the illustrated embodiments actuator 140 is configured as a hydraulic cylinder which may be controlled in the same or similar fashion as actuator 142. It shall be appreciated that either or both of actuators 140 and 142 may be provided in different configurations, for example, as ratchets, top links, or other actuators configured to provide appropriate displacement and force. It shall further be appreciated that either or both of actuators 140 and 142 may be omitted in certain embodiments. In such embodiments, vertical adjustment of a tool mount is preferably, though not necessarily, provided by actuators configured to adjust other structural elements of a machine, for example, adjustable wheel suspension elements configured to raise or lower a chassis or other structure supporting, directly or indirectly a tool mount, or via a variety of other actuators.

In the illustrated embodiments actuator 140 is selectably controllable to expand and contract in the Y-axis direction effective to cause rocker 124 to rotate relative to the chassis 102 about an axis parallel with the X-axis direction. Rotation of the rocker 124 is effective to raise and lower the tool mount 120 with the lifting member 121 over a first predetermined range from a maximum height to the point at which front wheels 104 and rear wheels 106 contact the ground surface underlying the work machine 100. Front wheels 104 and rear wheels 106 are structured to ride along the underlying ground surface and limit further downward motion of the tool mount 120 and structured coupled thereto while concurrently allowing further rotation of the rocker 124 to compress or decompress the springs 126 or other elements of suspension 125. Thus, rotation of the rocker 124 is effective to vary the amount of spring action force applied to the tool mount 120 by varying the compression of springs 126 without substantially changing the Z-axis position of the tool mount 120. The suspension 125 accommodates movement of the tool mount in response to external force applied thereto, for example, if the tool mount contacts an obstruction such as a rock or other structure located in a soil medium being worked.

In the illustrated embodiment, the lifting member 121 is in the form of a chain. It shall be appreciated that the chain form of the lifting member 121 is one example of a weight lifting structure that may be utilized to raise and lower a soil working tool or tool mount. Structures such as cables, jointed linkages, and other structures that limit relative displacement of a tool relative to a support structure to allow lifting through actuation in one direction, and deform, bend, flex, move, or otherwise accommodate movement. It shall be further appreciated that lifting member 121 (or other lifting member(s)) may be to provide different and variable preloading of the springs or compressible members of suspension 125.

Actuator 142 is selectably controllable to expand and contract generally in the Y-axis direction effective to cause tool mount 120 to rotate relative to the work machine about an axis generally parallel with the X-axis direction as indicated by arrow RM. In this manner, the pitch of the tool mount X-Y plane may be varied. This rotation can be utilized to rotate the grading tool assembly (raising one end and lowering the other) relative to the underlying ground surface and to control the force it applies to the underlying ground surface in the Z-axis direction.

Tool mount 120 is further coupled with a suspension 125 by a pivotable coupling. The suspension 125 is in turn connected to rocker 124 at a pivotable coupling. Rocker 124 is further coupled with the chassis 102 at a pivotable coupling. In the illustrated embodiments the suspension 125 is configured as a pair of telescoping cylinders in combination with springs 126 which are compressible between spring mounts through relative motion of the telescoping cylinders. It shall be appreciated that a variety of other suspensions may be utilized in various embodiments in addition to or instead of the illustrated configuration including shock absorbers, elastomeric suspension elements, compressible members, pneumatic suspension elements, hydraulic suspension elements, other spring arrangements and combinations of the foregoing and/or other suspension elements. It shall be further appreciated that a variety of springs and spring mounts may be utilized. In the illustrated embodiments springs 126 are helical and the spring mounts are crimped or compressed in place relative to respective shafts or cylinders of a telescoping assembly. In certain embodiments, the spring mounts may alternatively or additionally be welded, bonded, bolted, or otherwise fixedly coupled with respective suspension elements. Certain embodiments comprise spring mounts adjustably coupled with respective suspension elements, for example, through an axial threaded connection which may utilize one or more lock nuts or other locking members, or by a set screw, pin, or bolt.

The tool mount 120 is further coupled with a pulling linkage 130 at a pivotable coupling which rotates generally about an axis in parallel with the X-axis direction. Pulling linkage 130 is coupled with the chassis 102 of the work machine at a pivotable coupling which rotates about an axis in parallel with the X-axis direction. Pulling linkage is configured to provide a force vector component to the tool assembly in the forward or reverse Y-axis direction as the machine is propelled forward or backward. A force vector component generally in the Y-axis direction may also be provided, for example, during turning of the machine. Regardless of the particular direction, the pulling linkage provides one or more force vector components providing working force to the tool assembly. Furthermore, the rotation permitted by pivotable couplings between pulling linkage and the chassis 102 of the work machine accommodates both adjustment of the height and pitch of the tool assembly relative to the X-Y plane.

Work machine 100 includes a sighting gauge system 202 interconnected with suspension 125. Sighting gauge system 202 includes an outer member 204 and an inner member 206 which is moveable relative to inner member 206 in the direction generally illustrated by arrow 229. Outer member 204 is structured to be adjustably coupled with suspension member 128 at one end and to slidably receive inner member 206. Outer member 204 is adjustably coupled with suspension member 128 by a set screw which passes through an opening defined in outer member 204 and engages a threaded opening provided in suspension member and may be tightened to retain outer member 204 in a fixed position relative to suspension member 128 and loosened to permit adjustment of outer member 204 relative to suspension member 128 in the Z-axis direction. It shall be appreciated that sighting gauge system 202 is one example of a grading position indication system which is structured to provide a visually perceptible qualitative and quantitative indication of a difference between an automatic or automated commanded grading position for a grading tool and an actual position for the grading tool. In certain applications, sighting gauge system 202 is visible not only by a tool operator but also by bystanders up to 100 feet or greater distance from the work machine 100.

Work machine 100 includes a weight and rack system 510 which includes one or more weights 512 which include respective handles 516 and a rack 514 which receives the one or more weights 512. The rack 514 which is removably coupled with the chassis of work machine 100 by fasteners 513 toward the rear of rack 514 as well as by additional fasteners (not visible in the illustrated view) toward the front of rack 514. Weight and rack system 510 includes. A retaining rod 518 is coupled with rack 514 and passes through handles 516 to aid in retaining weights 512 to rack 514.

The weight and rack system 510 may be positioned at a distance along the length of the chassis such that the addition of one or more weights 512 to the rack 514 effective to increase the force which can be applied by the actuator to the suspension with the ground working tool in contact with the underlying ground surface and the force which is applied by the roller 552 to the underlying ground surface. In certain forms, the work machine 100 can be adjusted such that these forces are increased by an amount proportional to at least 1.5 times the mass of the one or more weights 512. In certain forms, the work machine 100 can be adjusted such that these forces are increased by an amount proportional to at least 2 times the mass of the one or more weights 512 weight. In certain forms, the weight and rack system 510 is positioned in the forward-most 15% of the length of the chassis. In certain forms, the weight and rack system 510 is positioned in the forward-most 5% of the length of the chassis.

Figure 6A:
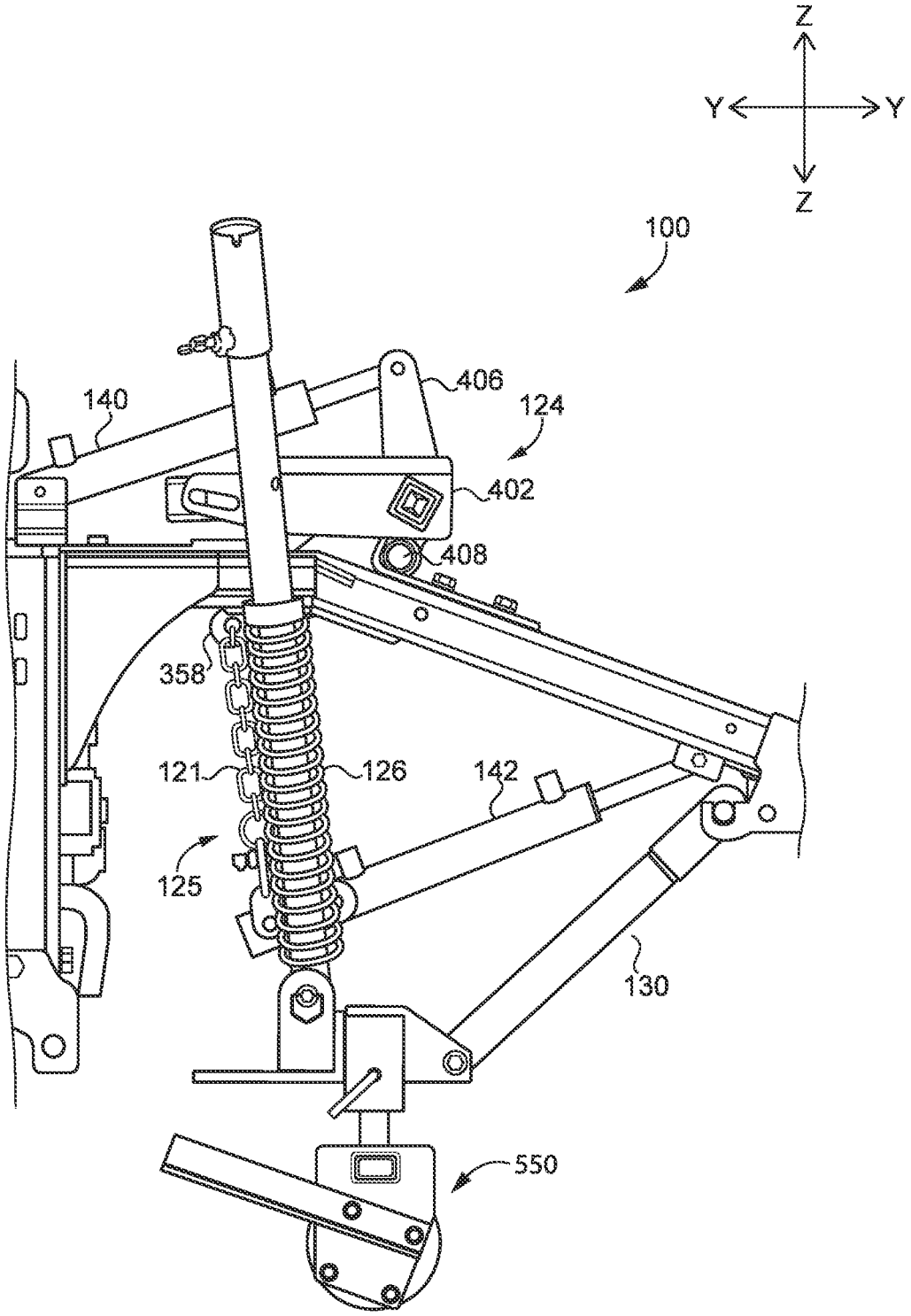
FIGS. 6A-6C is are side views illustrating certain aspects of the example work machine and ground engaging roller attachment of FIG. 1 in several states of adjustment.
Figure 6B:
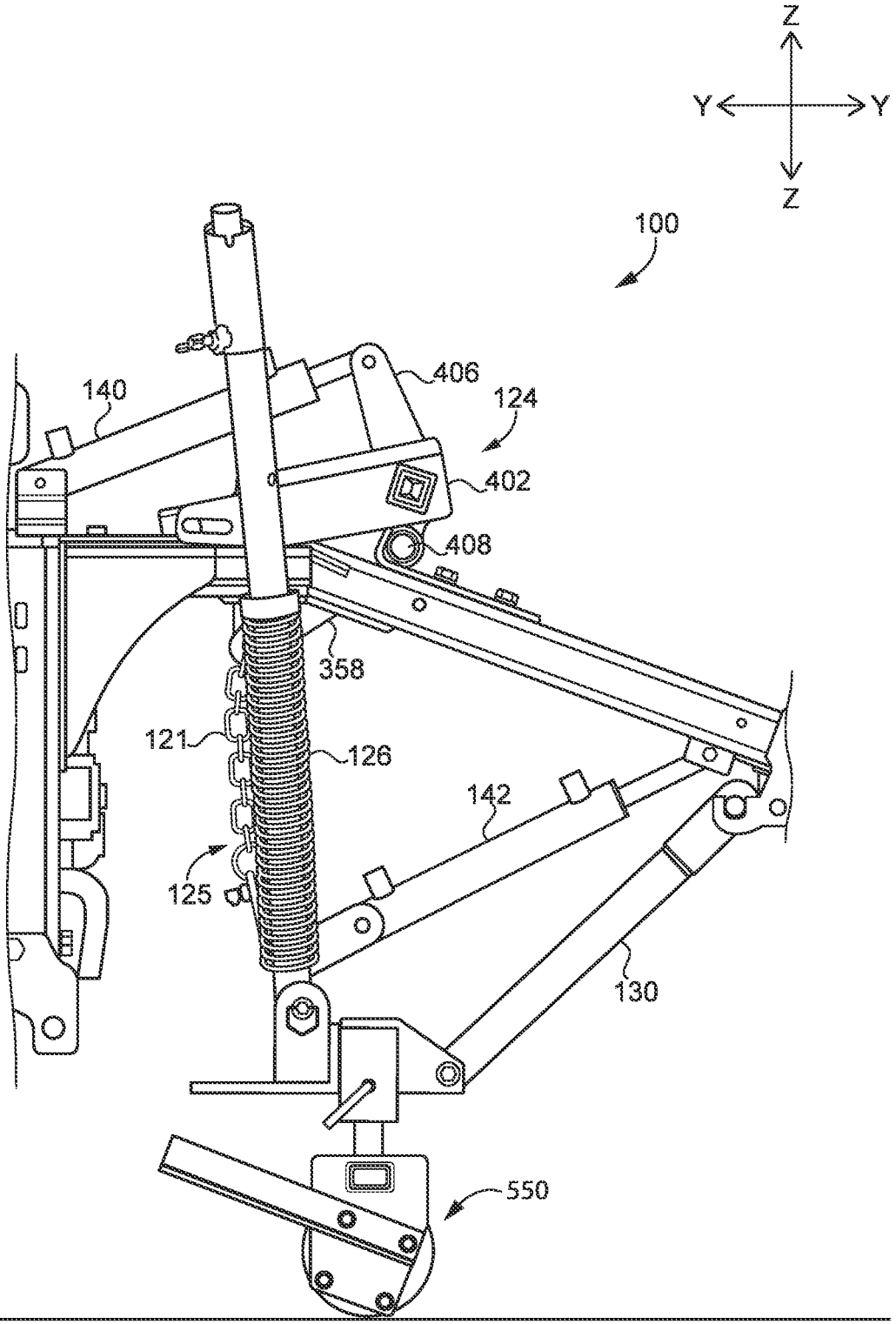
Figure 6C:
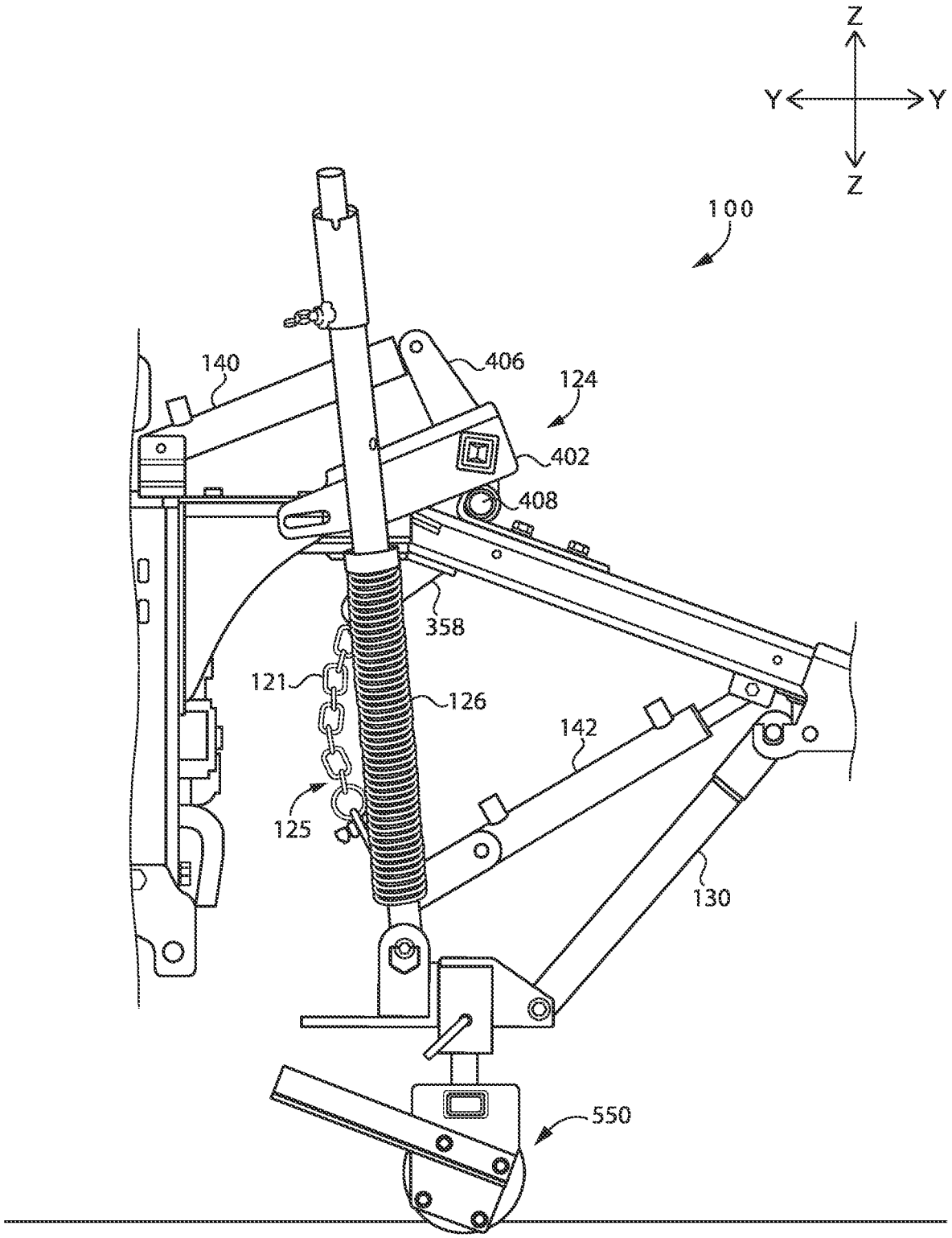

The inclusion and positioning of weight and rack system 510 is counterintuitive from conventional design perspectives which seek to minimize vehicle weight but With reference to FIGS. 6A-6C, work machine 100 is illustrated in a plurality of states of adjustment. In FIGS. 6A-6C, lifting connector 358 of rocker 124 is rotatably coupled with the chassis either by virtue of its connection with rocker 124 or via an additional rotatable coupling. Accordingly, lifting connector 358 is rotatable relative to the chassis 102 about a pivotable coupling at a point of rotation. Lifting connector 358 is also rotatably coupled with the arms of rocker 124 which are rotatable relative to chassis 102.

In the state of adjustment illustrated in FIG. 6A, the rotation and position of rocker 124 and lifting connector 358 are such that the roller assembly 550 coupled with tool mount 120 is raised above the underlying ground surface in the Z-axis direction by lifting force applied thereto by lifting member 121. Furthermore, springs 126 of suspension 125 are in an uncompressed state, or minimally compressed state such as when the springs 126 are preloaded, which may be referred to as a first state of compression. Additionally, the front wheels 104 and rear wheels 106, while not depicted in the view of FIG. 6A, are also in contact with the underlying ground surface in the illustrated state of adjustment.

In the state of adjustment illustrated in FIG. 6B, the rotation and position of the rocker 124 and lifting connector 358 are such that the roller assembly 550 coupled with tool mount 120 has been lowered into contact with the underlying ground surface in the Z-axis direction by lifting member 121 which no longer applies a lifting force and is instead provided with a first degree of slack. Furthermore, springs 126 of suspension 125 are in a more compressed state relative to the first state of compression by virtue of compressive force applied thereto by which may be referred to as a second state of compression. Additionally, the front wheels 104 and rear wheels 106, while not depicted in the view of FIG. 6B, are also in contact with the underlying ground surface in the illustrated state of adjustment.

In the state of adjustment illustrated in FIG. 6C, the rotation and position of the rocker 124 and lifting connector 358 are such that the roller assembly 550 coupled with tool mount 120 has been lowered into contact with the underlying ground surface in the Z-axis direction by lifting member 121 which no longer applies a lifting force and is instead provided with a second degree of slack. Furthermore, springs 126 of suspension 125 are in a more compressed state relative to the second state of compression by virtue of compressive force applied thereto by which may be referred to as a third state of compression. The greater force provided by the third state of compression is applied to roller assembly 550 which may be effective to force the roller 552 deeper into the underlying ground surface. Additionally, the rear wheels 106, while not depicted in the view of FIG. 6C, are also in contact with the underlying ground surface. On the other hand, the front wheels 104, while not depicted in the view of FIG. 6C, may or may not be in contact with the underlying ground surface depending on whether the magnitude of force applied by the rocker 124 to the suspension 125 is sufficient to raise the front wheels 104 above the underlying ground surface which may be referred to as a wheelie state of adjustment.

Figure 7:
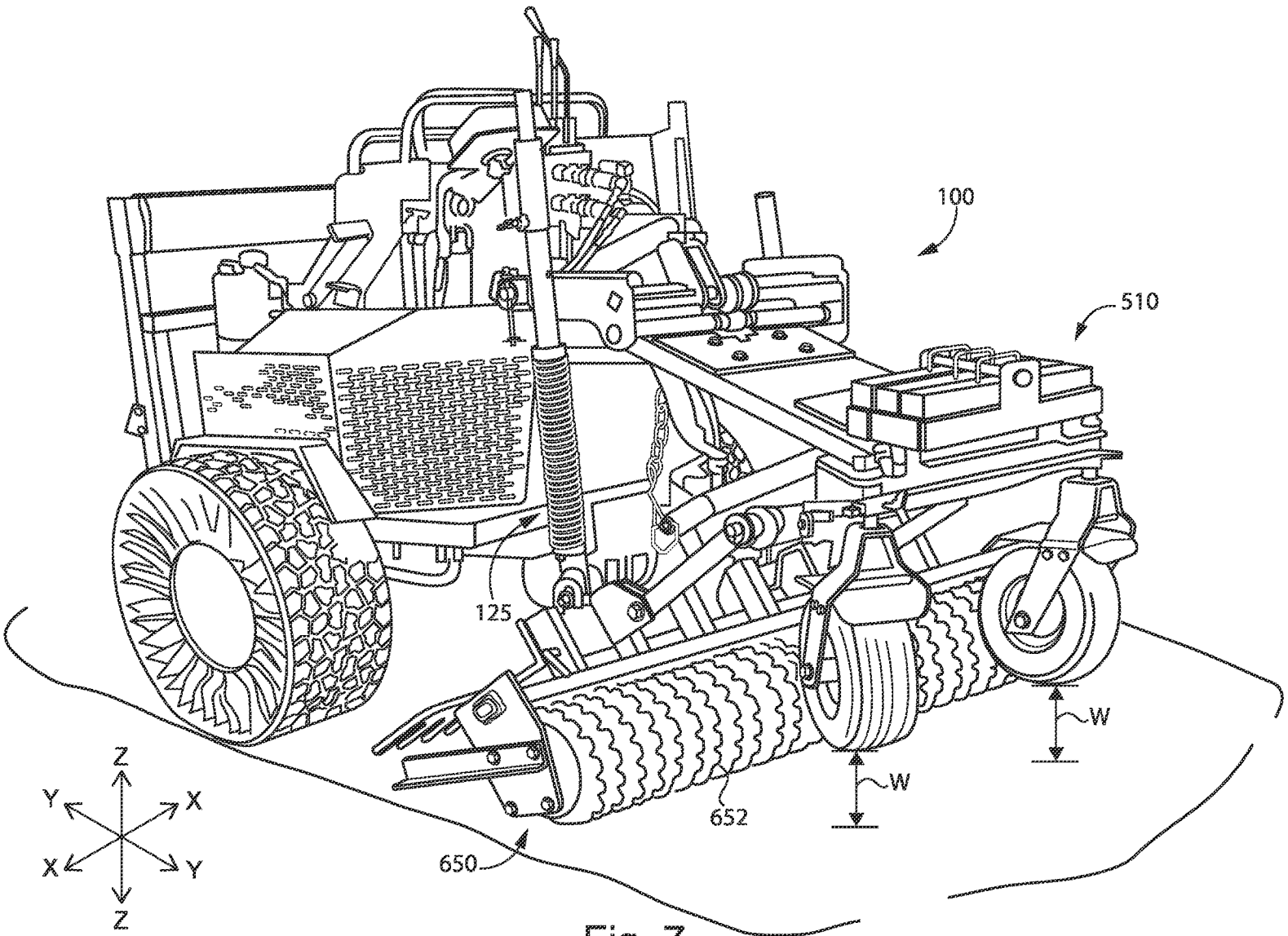
FIG. 7 is a perspective view illustrating certain aspects of an example work machine operatively coupled with a ground engaging roller attachment in an example state of operational adjustment.

FIG. 7 further illustrates an example of a wheelie state of adjustment wherein a magnitude of force applied by the rocker 124 to the suspension 125 is sufficient to raise the front wheels 104 above the underlying ground surface by a distance as indicated by arrows W. As illustrated in FIG. 7, work machine 100 operatively coupled with roller assembly 650. Roller assembly 650 may include all of the features and components described in connection with roller assembly 550 but is provided with a culipactor roller 652 comprising rows of toothed wheels rather than a smooth cylindrical outer surface as in the case of roller 552. It shall be appreciated that a wheelie state of adjustment may be provided via the application of force to the roller assembly 550, roller assembly 650, or other types of roller assemblies coupled with a work vehicle such as work machine 100.

In a wheelie state of adjustment, work machine 100 can be propelled by driving force applied to rear wheels 106 in substantially the same directions as in sates of adjustment wherein front wheels 104 are in contact with the underlying ground surface, for example, straight or turning in either forward or reverse. For example, a prime mover of work machine 100 may be configured to independently selectably drive the first and second rear wheels 106 in a forward direction and a reverse direction in response to operator input such that the work machine can be propelled forward and backward and steered left and right with the suspension and the roller in any of the positions illustrated in FIGS. 6A, 6B, 6C, and FIG. 7. Additionally, in a wheelie state of adjustment, the addition or removal of weights to weight and rack system 510 may define further states of adjustment of the work machine 100.

With reference to FIGS. 8A-8D there are illustrated schematic depictions of certain aspects of work machine 100 and roller assembly 550 in a plurality of states of adjustment. It shall be appreciated that the states of adjustment illustrated in FIGS. 8A-8C corresponding to the states of adjustment illustrated in FIGS. 6A-6C, respectively. FIGS. 8A-8D further illustrate force vectors and variation thereof in the different states of adjustment. In the state of adjustment illustrated in FIG. 8A, a rear force indicated by arrow Fra is applied by the rear wheels 106 to the underlying ground surface, a forward force indicated by arrow Ffa is applied by the front wheels 104 to the underlying ground surface, and the sum of the forces indicated by arrows Fra and Ffa is proportional to the net weight of the work machine.

Figure 8A:
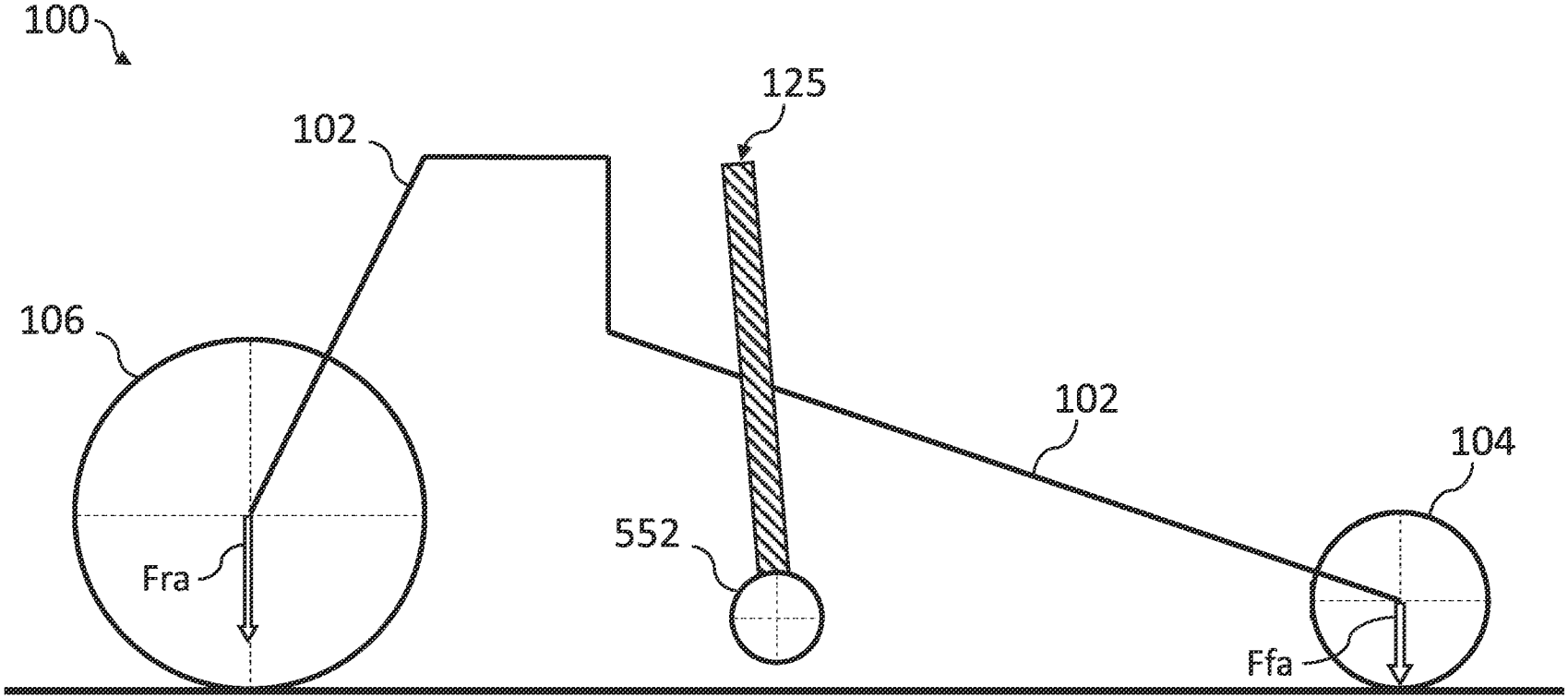
FIGS. 8A-8D are schematic diagrams illustrating force vectors associated with an example work machine in several states of operational adjustment.
Figure 8B:
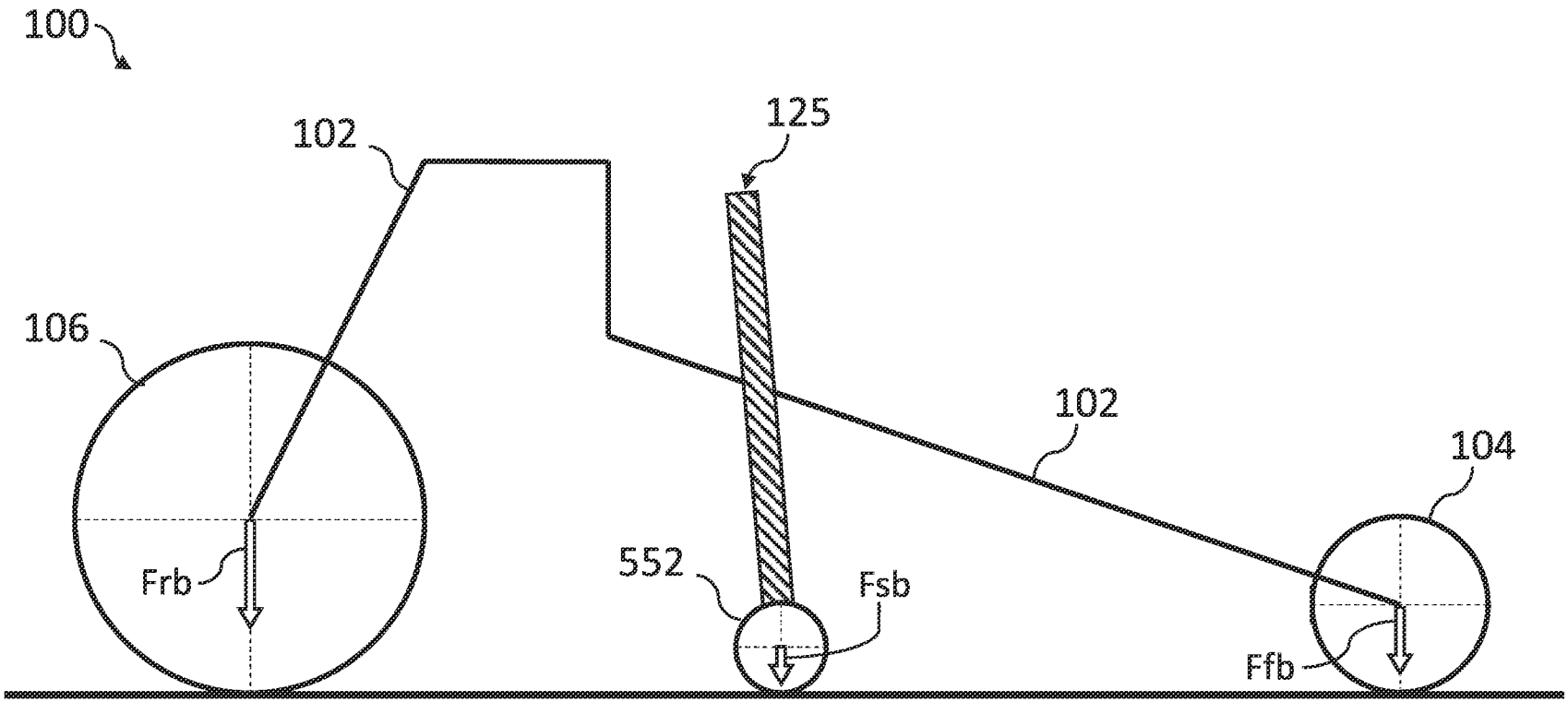

In the state of adjustment illustrated in FIG. 8B, a rear force indicated by arrow Frb is applied by the rear wheels 106 to the underlying ground surface, a forward force indicated by arrow Ffb is applied by the front wheels 104 to the underlying ground surface, and a middle force indicated by arrow Fsb is applied by the roller 552 to the underlying ground surface in proportion to the force applied by the suspension 125 to the roller 552 by the operation of the actuators and operation controls as described above. The sum of the forces indicated by arrows Frb, Ffb, and Fsb is again proportional to the net weight of the work machine; however, the addition of the force indicated by arrow Fsb decreases the magnitude of one or both of the force indicated by arrow Frb and the force indicated by arrow Ffb.

Figure 8C:
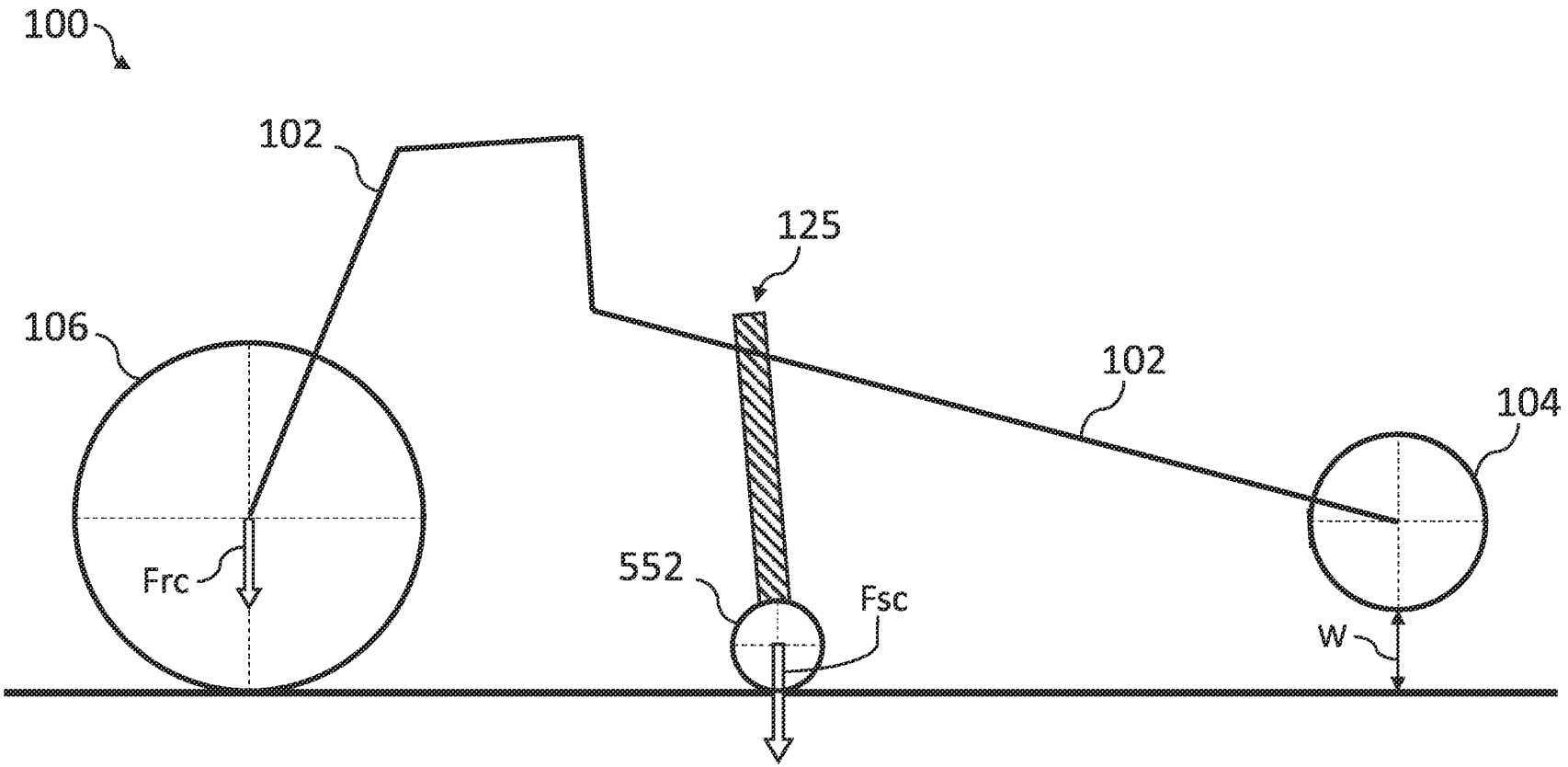

In the state of adjustment illustrated in FIG. 8C, a rear force indicated by arrow Frc is applied by the rear wheels 106 to the underlying ground surface, a middle force indicated by arrow Fsc is applied by the roller 552 to the underlying ground surface in proportion to the force applied by the suspension 125 to the roller 552 by the operation of the actuators and operation controls as described above, and no force is applied by the front wheels which are raised and suspended above the underlying ground surface as indicated by arrow W. The sum of the forces indicated by arrows Frc and Fsc is again proportional to the net weight of the work machine; however, the magnitude of the force indicated by arrow Fsc is increased relative to the force indicated by arrow Fsc proportional to the weight of the suspended forward portion of the work machine 100 by virtue of the cantilevered or levered configuration of work machine 100. This has the effect of decreasing the magnitude of the force indicated by arrow Frc relative to the force indicated by arrow Ffb.

Figure 8D:
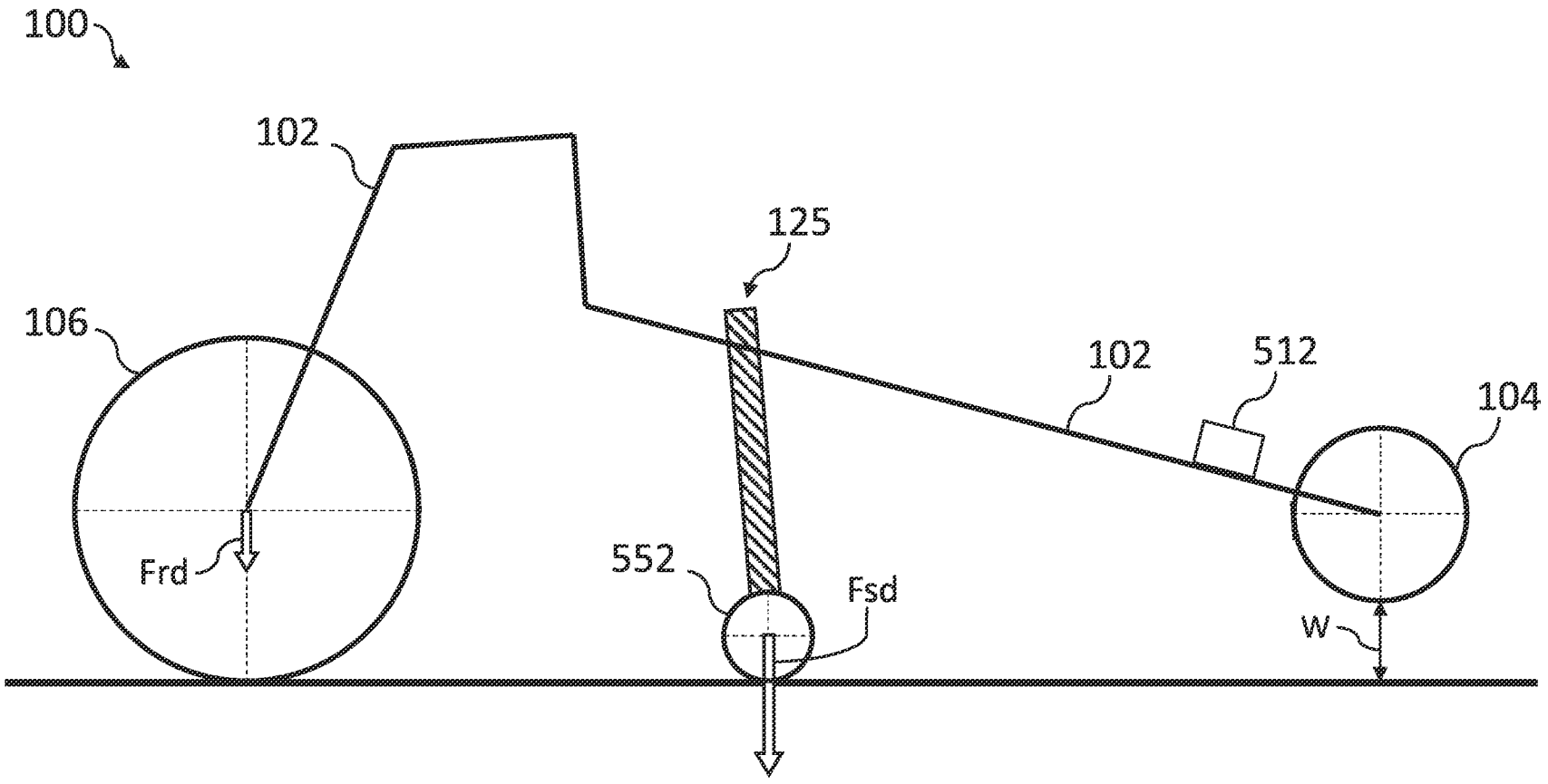

In the state of adjustment illustrated in FIG. 8D, a rear force indicated by arrow Frd is applied by the rear wheels 106 to the underlying ground surface, a middle force indicated by arrow Fsd is applied by the roller 552 to the underlying ground surface in proportion to the force applied by the suspension 125 to the roller 552 by the operation of the actuators and operation controls as described above, and no force is applied by the front wheels which are raised above the underlying ground surface as indicated by arrow W. The sum of the forces indicated by arrows Frd and Fsd is again proportional to the net weight of the work machine; however, the magnitude of the force indicated by arrow Fsd is increased relative to the force indicated by arrow Fsc by the addition of one or more weights 512 to the weight and rack system 510 of the work machine 100.

The addition of one or more weights 512 to work machine 100 has the effect of rebalancing the weight distribution of work machine 100 by decreasing the magnitude of the force indicated by arrow Frd relative to the force indicated by arrow Ffc while increasing the force indicated by arrow Fsd. Thus, the overall weight of the work machine has increased by the addition of one or more weights 512 at a location along the work machine 100 which is now suspended above the underlying ground surface and a leverage multiplier applies an even greater force than the weight of one or more weights 512 with a corresponding decrease in the force indicated by arrow Fsd, for example, by an amount proportional to at least 1.5 times the mass of the ballast weight in certain forms or an amount proportional to at least 2 times the mass of the ballast weight in certain forms.

It shall be appreciated that the addition of one or more weights 512 may in principle occur in any state of adjustment, including those illustrated in any of FIGS. 6A-6C or 8*a*-8C, but is preferably performed with both the front and rear wheels contacting the underlying ground surface. Furthermore, the addition of one or more weights 512 is preferably selected to maintain rear wheels 106 in operative contact with the underlying ground surface, while also decreasing their weight and resulting deformation or compaction of the underlying ground surface. Thus, for example, weight and rack system 510 may be configured such that the total weight of one or more weights 512 carried by the weight and rack system 510 is at or within a margin of error for maintaining rear wheels 106 in contact with the underlying ground surface, and that the total weight may be divided among multiple weights to permit the operator to select or tune the rebalancing which occurs due to changes in the added weight. Rebalancing may be performed to change the performance of the work machine 100, for example, rebalancing by adding or removing weight may be utilized to vary downforce on the driving wheels depending on the conditions of the underlying ground (e.g., traction on wet ground may benefit from increased downforce.)

Figure 9:
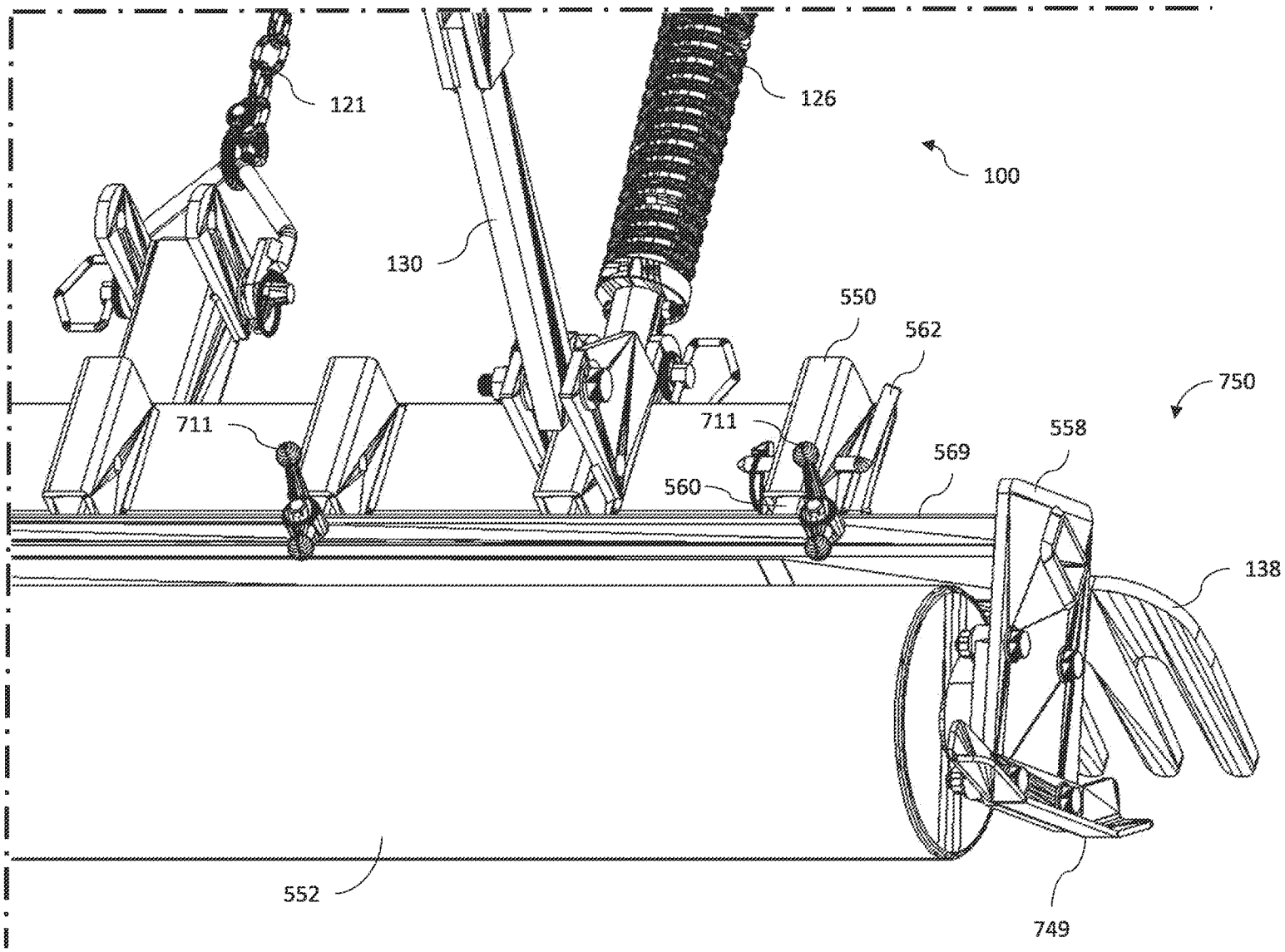
FIG. 9 is a front perspective view illustrating certain aspects of the example work machine operatively coupled with another example ground engaging roller attachment.
Figure 10:
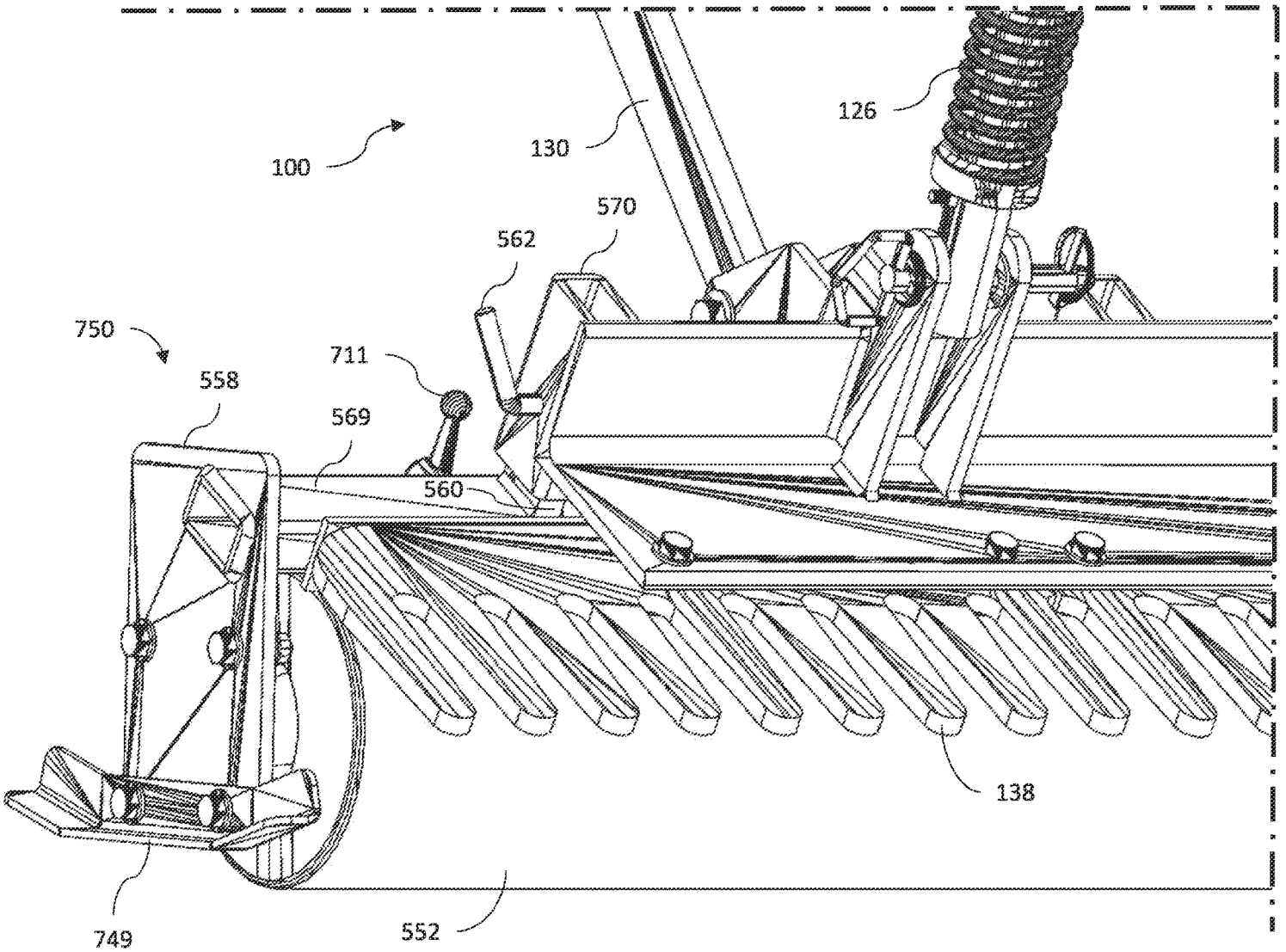
FIG. 10 is a front perspective view illustrating certain aspects of the example of a ground engaging roller attachment of FIG. 9.
Figure 11:
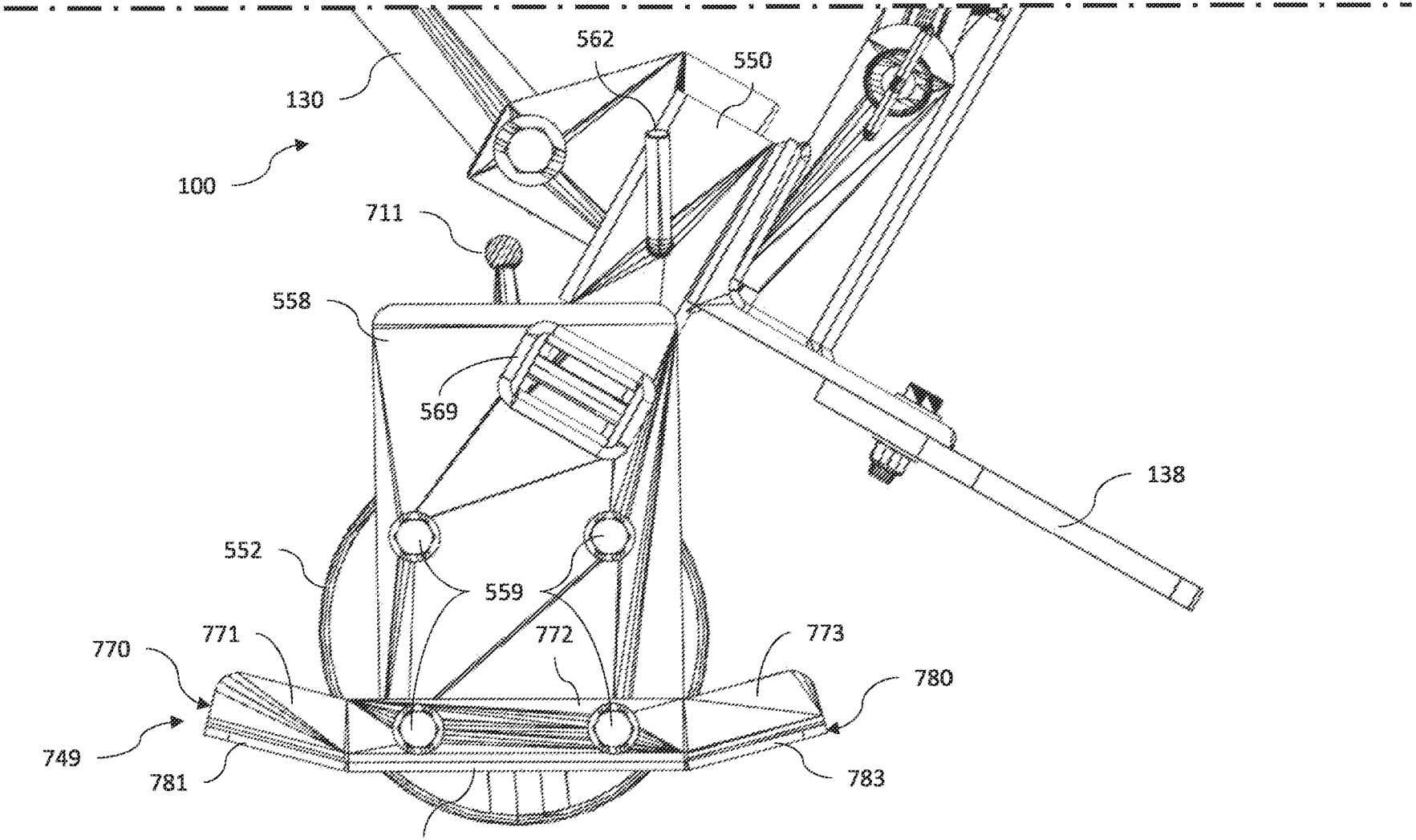
FIG. 11 is a side view illustrating certain aspects of the example of a ground engaging roller attachment of FIG. 9.

With reference to FIGS. 9-11, there are illustrated several views of another example ground engaging roller attachment including a roller assembly 750 operatively coupled with the work machine 100. Roller assembly 750 includes a number of features which are the same as or substantially similar to corresponding features of roller assembly 550 a number of which are indicated with the same reference numerals utilized in connection with roller assembly 550. Roller assembly 750 also differs from roller assembly 550 in a number of aspects which are further described below. Accordingly, it shall be appreciated that the description of work machine 100 and roller assembly 550 also applies to roller assembly 750 with the exception of the noted differences.

Roller assembly 750 includes a hanger stop member 749 which is coupled with one of the hanger members 558 and extends along the length of the chassis 102. In certain forms, an additional hanger stop member 749 is coupled with the other one of hanger members 558. Hanger stop member 749 differs from the hanger stop member 549 of roller assembly 550 in several respects. Hanger stop member 749 includes a vertically-oriented portion 770 including a vertically-oriented forward section 771, a vertically-oriented middle section 772, and vertically-oriented rearward section 773 and horizontally-oriented portion 780 including a horizontally-oriented forward section 781, a horizontally-oriented middle section 782, and horizontally-oriented rearward section 783. Both forward sections 771, 781, on the one hand, and rearward sections 773, 783, on the other hand, are configured with respective angles and lengths which maintain roller assembly 750 in a substantially predetermined range of position when decoupled from tool mount 120 by virtue of one roller assembly 750 rotating such that one or both of the forward sections 771, 781 or one or both of the rearward sections 773, 783 of the hanger stop member 749 contacting an underlying ground surface effective to limit rotation of hanger member 558 to a predetermined range of positions.

When roller assembly 750 is decoupled from work machine 100, hanger stop member 749 can rotate downward in either a forward direction or a rearward direction into engagement with the underlying ground surface effective to limit hanger stop member 749 to a predetermined range of positions. Hanger members 558, lateral member 559, and post members 560 which are coupled in a fixed relationship with one another and with hanger stop member 749, are also maintained within the predetermined range of positions. The predetermined position may be selected to provide a predetermined angle and orientation of post members 560 relative to an underlying ground surface when hanger stop member 549 contacts and rests upon the underlying ground surface. The predetermined position may be selected to correspond with a particular adjustment state of tool mount 120 which can be achieved via the operation of operator controls 150. The hanger stop member 749 is preferably configured with a ground facing surface, such as the lower surface provided in the L-shaped cross-section of the illustrated embodiment, with a width in the effective limit a depth of penetration of hanger stop member 749 into the underlying ground surface relative to the penetration realized by a sharper or more narrow ground-contacting portion surface. Hanger stop member 749 also provides a visual indicia of the pitch at which the roller assembly 750 and the tool mount 120 have been adjusted relative to the underlying ground surface.

When roller assembly 750 is coupled with work machine 100, hanger stop member 749 can rotate over a predetermined range of positions to accommodate adjustment of the roller assembly 750. In certain forms, the angle of one or more portions of hanger stop member 749 may be selected to indicate a preferred positioning of the tool mount and suspension of work machine 100 when coupled with roller assembly 700. For example, middle sections 772, 782 may be oriented relative to post members 560 such when the middle sections 772, 782 are substantially parallel with an underlying ground surface, the tool mount and suspension of work machine 100 are oriented in a desired position for operation in a wheelie state of adjustment. The desired position for operation in a wheelie state of adjustment may include a suspension angle selected to mitigate undesired forward tipping or rotation of the work machine, e.g., a rearward leaning suspension angle. In other forms, forward sections 771, 781 or rearward sections 773, 783 may be oriented relative to post members 560 such when the middle sections forward sections 771, 781 or rearward sections 773, 783 are substantially parallel with an underlying ground surface, the tool mount and suspension of work machine 100 are oriented in a desired position for operation in a wheelie state of adjustment.

Hanger stop member 749 is positioned at and coupled with a lower portion of hanger member 558. This positioning allows the length of the forward sections 771, 781 and the rearward sections 773, 783 of hanger stop member 749 to be reduced relative to hanger stop member 749. In the illustrated form the lower portion is substantially co-extensive with the lowermost portion of hanger member 558, however, other embodiment may position and couple hanger stop member 749 at other positions relative to hanger member 558. The positioning and extent of hanger stop member 749 permits actuators 140 and 142 to be adjusted to vary the height and pitch of roller assembly 750 and finishing comb among and between a first position wherein the roller assembly 750 is in contact with and works the underlying ground surface and the finishing comb 138 is raised above and does not contact the underlying ground surface, a second position wherein both the roller assembly 750 and the finishing comb are in contact with and work the underlying ground surface, and a third position wherein the finishing comb 138 is in contact with and works the underlying ground surface and the roller assembly 750 is raised above and does not contact the underlying ground surface. Roller assembly also includes While example embodiments have been illustrated and described in detail in the drawings and foregoing description, the same is to be considered as illustrative and not restrictive in character, it being understood that only certain example embodiments have been shown and described and that all changes and modifications that come within the spirit of the inventions are desired to be protected. It should be understood that while the use of words such as preferable, preferably, preferred or more preferred utilized in the description above indicates that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Language indicating spatial or geometric relationships, directions or characteristics shall be understood to include and encompass relationships that are within a margin of variation which a person of skill in the art would deem acceptable for a given application.

The invention claimed is:

1. A work machine comprising:

a chassis having a length, a width, and a height;

first and second ground-contacting members rotatably coupled with the chassis at a rearward location along the length of the chassis;

third and fourth ground-contacting members rotatably coupled with the chassis at a forward location along the length of the chassis;

a roller rotatably coupled with the chassis by a suspension and positioned intermediate the rearward location and the forward location along the length of the chassis, the suspension being compressible; and an actuator operatively coupled with the chassis and the suspension, the actuator being adjustable adjust the suspension and the roller to:

a first position wherein the roller is raised above an underlying ground surface with the first, second, third and fourth ground-contacting members contacting the underlying ground surface, a second position wherein the roller is in contact with the underlying ground surface with the first, second, third and fourth ground-contacting members contacting the underlying ground surface, a third position wherein the roller is in contact with the underlying ground surface with the first and second ground-contacting members contacting the underlying ground surface and the third and fourth ground-contacting members raised above the underlying ground surface and a the suspension is under a first degree of compression; and a fourth position wherein the roller is in contact with the underlying ground surface with the first and second ground-contacting members contacting the underlying ground surface and the third and fourth ground-contacting members raised above the underlying ground surface and a the suspension is under a second degree of compression, the second degree of compression being one of greater than and less than the first degree of compression;

wherein the downforce applied to the underlying ground surface by the first and second ground-contacting members in the third position is less than in the first position.

2. The work machine of claim 1 comprising a prime mover configured to independently selectably drive the first and second ground-contacting members in a forward direction and a reverse direction in response to operator input such that the work machine can be propelled forward and backward and steered left and right with the suspension and the roller in any of the first position, the second position and the third position.

3. The work machine of claim 1 comprising a weight and rack system comprising at least one weight removably secured to a rack positioned forward of the roller.

4. The work machine of claim 3 wherein the weight and rack system is positioned in the forward-most 15% of the length of the chassis.

5. The work machine of claim 3 wherein the weight and rack system is positioned at a distance along the length of the chassis effective to increase the force which can be applied by the roller to the underlying ground surface by an amount proportional to at least 1.5 times the mass of the ballast weight.

6. The work machine of claim 1 wherein the roller comprises:

a roller body extending along the width of the chassis;

an end member positioned at an end of the roller body;

a stud extending from the end member;

a bearing assembly including a stud receptacle in which the stud is received, a bearing surrounding the stud receptacle, and a bearing housing containing the bearing; and a hanger member coupled with the bearing assembly.

7. The work machine of claim 6 wherein the roller comprises a hanger stop member coupled with the hanger member and extending along the length of the frame.

8. The work machine of claim 6 wherein the roller comprises:

a second end member positioned at a second end of the cylindrical body;

a second stud extending from the second end member;

a second bearing assembly including a second stud receptacle in which the second stud is received, a second bearing surrounding the second stud receptacle, and a second bearing housing containing the second bearing;

a second hanger member coupled with the second bearing assembly; and a hanger shaft coupled with and extending between the hanger member and the second hanger member.

9. The work machine of claim 1 comprising a sighting gauge operatively coupled with the suspension system.

10. The work machine of claim 9 wherein the sighting gauge includes visually perceptible markings indicative of a magnitude of force being applied to the underlying ground surface.

11. A work machine comprising:

a chassis extending along a length, a width, and a height;

a first ground-contacting member rotatably coupled with the chassis at a first location;

a second ground-contacting member rotatably coupled with the chassis at a second location rearward of the first location along the length of the chassis;

a suspension system adjustably coupled with the chassis at a third location intermediate the first location and the second location along the length of the chassis and including a compressible member configured to expand and contract in response to variation in force applied to the suspension system;

a ground working tool operatively coupled with the suspension system;

a ballast weight removably coupled with the chassis at a fourth location forward from the third location along the length of the chassis; and an actuator configured to selectably vary positioning of the suspension system over a range including a first position in which the ground working tool is spaced apart from an underlying ground surface and the compressible member is in a first state of compression, a second position in which the ground working tool contacts the underlying ground surface and the compressible member is in a second state of compression greater than the first state of compression a third position in which the ground working tool contacts the underlying ground surface and the compressible member is in a third state of compression greater than the second state of compression, and a fourth position in which the ground working tool contacts the underlying ground surface and the compressible member is in a fourth state of compression, the fourth state of compression being one of greater than and less than the third state of compression.

12. The work machine of claim 11 wherein the ground working tool comprises a culipactor roller.

13. The work machine of claim 12 wherein the roller is rotatably coupled with a bearing positioned at side extremity of the roller, the bearing is coupled with a coupling member extending upward from the bearing along the height of the chassis, and the coupling member is removably coupled with a tool mount which is coupled with the suspension system.

14. The work machine of claim 13 wherein the coupling member is removable from the tool mount by hand without using a tool.

15. The work machine of claim 11 wherein the ballast weight is positioned in the forward-most 15% of the length of the chassis.

16. The work machine of claim 15 wherein the ballast weight is positioned in the forward-most 5% of the length of the chassis.

17. The work machine of claim 11 wherein the fourth location is at a distance along the length of the chassis effective to increase the force which can be applied by the actuator to the suspension with the ground working tool in contact with the underlying ground surface by an amount proportional to at least 1.5 times the mass of the ballast weight.

18. The work machine of claim 17 wherein said amount proportional is proportional to at least 1.7 times the mass of the ballast weight.

19. The work machine of claim 11 comprising a sighting gauge operatively coupled with the suspension system.

20. The work machine of claim 11 wherein the sighting gauge includes visually perceptible markings indicative of a magnitude of force being applied to the underlying ground surface.

* * * * *